US006537043B1

(12) United States Patent
Chen

(10) Patent No.: US 6,537,043 B1
(45) Date of Patent: Mar. 25, 2003

(54) COMPRESSOR DISCHARGE VALVE HAVING A CONTOURED BODY WITH A UNIFORM THICKNESS

(75) Inventor: Jianxiong Chen, Sidney, OH (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 09/947,073

(22) Filed: Sep. 5, 2001

(51) Int. Cl.[7] ..... F04C 18/04; F04C 18/356; F16K 15/00

(52) U.S. Cl. ..... 418/55.1; 418/63; 418/270; 137/543.17

(58) Field of Search ..... 418/55.1, 63, 270; 417/559, 569; 137/543.17, 540, 543.23

(56) References Cited

U.S. PATENT DOCUMENTS

| | | | | | |
|---|---|---|---|---|---|
| 2,133,575 | A | | 10/1938 | Rosenberg | 137/483.2 |
| 2,433,302 | A | | 12/1947 | Snyder | 137/493.8 |
| 2,986,159 | A | | 5/1961 | Snyder | 137/493 |
| 3,127,906 | A | | 4/1964 | Balster | 137/493 |
| 3,244,195 | A | * | 4/1966 | Wanner | 137/543.17 |
| 4,445,534 | A | * | 5/1984 | King | 137/543.17 |
| 4,472,122 | A | * | 9/1984 | Yoshida et al. | 418/63 |
| 4,537,566 | A | | 8/1985 | Blass et al. | 417/569 |
| 4,570,972 | A | | 2/1986 | Pangos | 137/493 |
| 5,342,183 | A | | 8/1994 | Rafalovich et al. | 418/55.1 |
| 5,346,375 | A | * | 9/1994 | Akiyama et al. | 418/55.1 |
| 5,469,716 | A | | 11/1995 | Bass et al. | 418/55.6 |
| 5,819,794 | A | * | 10/1998 | Anderson | 137/543.17 |
| 6,027,321 | A | * | 2/2000 | Shim et al. | 418/55.1 |
| 6,139,291 | A | | 10/2000 | Perevozchikov | 418/55.1 |
| 6,390,792 | B1 | * | 5/2002 | Tarng et al. | 418/270 |

FOREIGN PATENT DOCUMENTS

| | | | |
|---|---|---|---|
| JP | 55-146294 | * 11/1980 | 418/63 |
| JP | 60-93194 | * 5/1985 | 418/63 |
| JP | 4-279782 | * 10/1992 | 418/55.1 |
| JP | 6-10868 | * 1/1994 | |

* cited by examiner

*Primary Examiner*—John J. Vrablik
(74) *Attorney, Agent, or Firm*—Harness, Dickey & Pierce, P.L.C.

(57) ABSTRACT

A discharge valve is provided for implementation between a discharge pressure zone and a discharge chamber. The discharge valve is operable between an open position for enabling fluid flow between the discharge pressure zone and the discharge chamber and a closed position for prohibiting fluid flow between the discharge pressure zone and the discharge chamber. The discharge valve includes a housing defining a cavity and having a flow aperture therethrough. A valve disc is slidably disposed within the housing and is operable for defining the open and closed positions of the discharge valve. The valve disc includes a contoured body for reducing stresses experienced within the valve disc and improving fluid flow therearound.

33 Claims, 5 Drawing Sheets

10
12
14
16
18
20
22
24
26
30
32
34
36
38
40
42
46
50
52
54
56
58
60
62
64
66
68
70
72
76
80
82
84
86
88
90
92
94
98
100

COMPRESSOR DISCHARGE VALVE HAVING A CONTOURED BODY WITH A UNIFORM THICKNESS

FIELD OF THE INVENTION

The present invention relates to compressors. More particularly the present invention relates to a discharge valve incorporating a contoured discharge valve disc.

BACKGROUND AND SUMMARY OF THE INVENTION

Scroll machines are becoming more and more popular for use as compressors in both refrigeration as well as air conditioning and heat pump applications due primarily to their capability for extremely efficient operation. Generally, these machines incorporate a pair of intermeshed spiral wraps which are caused to orbit relative to one another so as to define one or more moving chambers which progressively decrease in size as they travel from an outer suction port towards a center discharge port. An electric motor is normally provided to cause the relative orbiting scroll movement.

Because scroll compressors depend upon successive chambers for suction, compression, and discharge processes, suction and discharge valves in general are not required. However, the performance of the compressor can be increased with the incorporation of a discharge valve. One of the factors that will determine the level of increased performance is the reduction of what is called the recompression volume. The recompression volume is the volume of the discharge chamber and discharge port of the compressor when the discharge chamber is at its smallest volume. The minimization of this recompression volume will result in a maximizing of the performance of the compressor.

In addition, when such compressors are shut down, either intentionally as a result of the demand being satisfied, or unintentionally as a result of a power interruption, there is a strong tendency for the backflow of compressed gas from the discharge chamber and to a lesser degree for the gas in the pressurized chambers to effect a reverse orbital movement of the scroll members and any associated drive shaft. This reverse movement often generates noise or rumble, which may be considered objectionable and undesirable. Further, in machines employing a single phase drive motor, it is possible for the compressor to begin running in the reverse direction should a momentary power interruption be experienced. This reverse operation may result in overheating of the compressor and/or other inconveniences to the utilization of the system. Additionally, in some situations, such as a blocked condenser fan, it is possible for the discharge pressure to increase sufficiently to stall the drive motor and effect a reverse rotation thereof. As the orbiting scroll orbits in the reverse direction, the discharge pressure will decrease to a point where the motor again is able to overcome this pressure head and orbit the scroll member in the forward direction. However, the discharge pressure will again increase to a point where the drive motor is stalled and the cycle is repeated. Such cycling is obviously undesirable. The incorporation of a discharge valve can reduce or eliminate these reverse rotation problems.

Traditional discharge valves include a flat disc that is operable between an open and a closed position for selectively enabling the flow of pressurized gas through the discharge valve. As a result of the pressure differential on either side of the flat disc the flat disc experiences significant, cyclical tensile stresses. Over time, these stresses may fatigue the flat disc and result in failures. To cope with these stresses, flat discs generally have a thicker profile and thus are heavier than desired. Increased weight results in slower response time as the disc moves between its open and closed positions.

Therefore, it is desirable in the industry to provide a discharge valve assembly having an improved disc design. The improved disc design should reduce the tensile stresses the disc experiences due to pressure differentials and preferably improve the flow through the discharge valve for lowering the pressure differential, thereby lowering the experienced tensile stress. Further, in reducing the tensile stresses, the improved disc design should have a thinner profile, thereby reducing the weight of the disc and improving response of the disc to pressure changes.

In a first embodiment, the present invention resides in the provision of a contoured disc valve in a scroll compressor, and in an alternative embodiment in a conventional single-vane rotary compressor.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
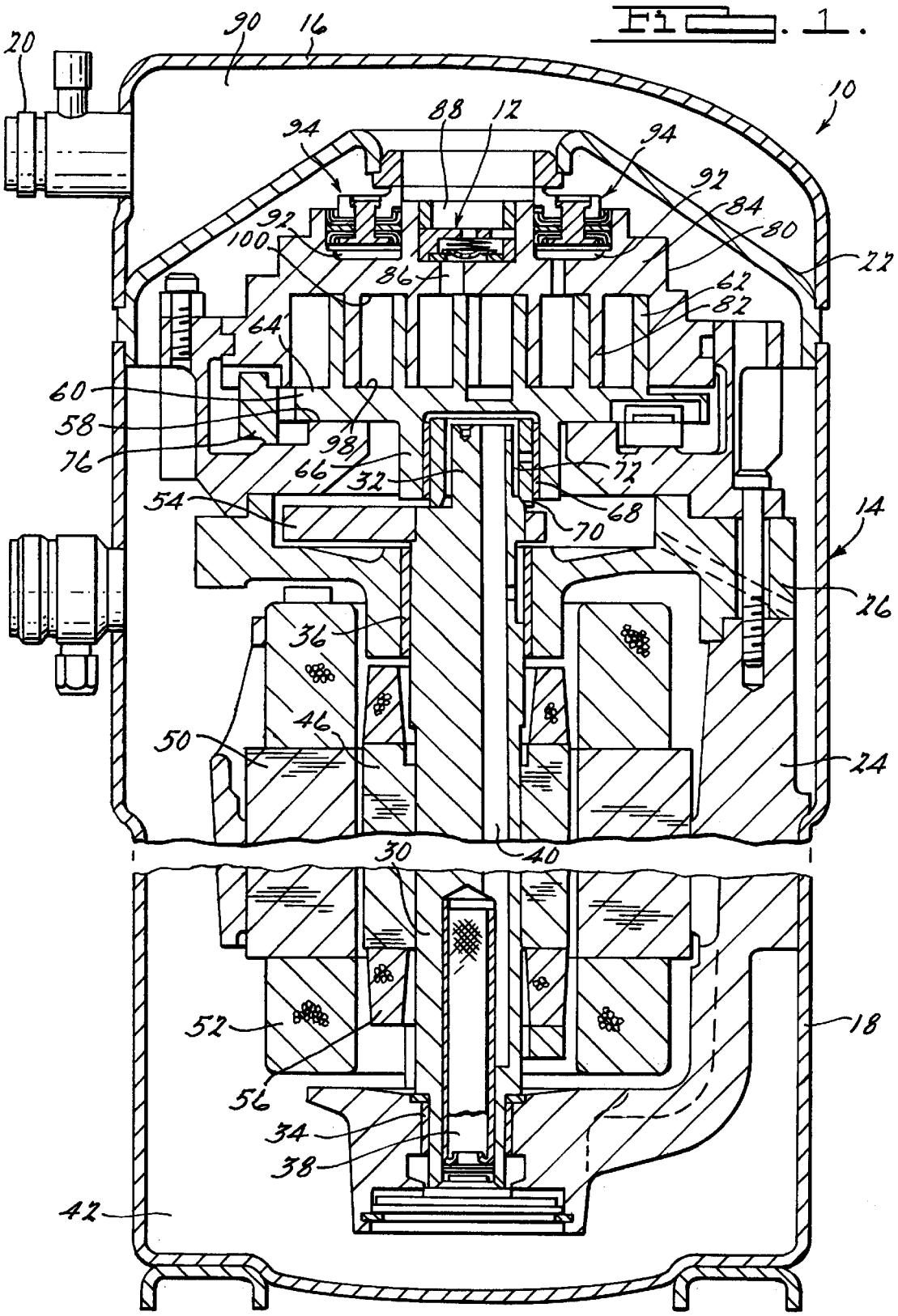
FIG. 1 is a vertical sectional view through the center of a scroll compressor which incorporates a discharge valve assembly according to the principles of the present invention.

At the outset, it is noted that the herein described compressor embodiments are the subject of commonly assigned U.S. Pat. No. 6,139,291 to Perevozchikov, the disclosure of which is incorporated herein be reference. Referring now to the drawings in which like reference numerals designate like or corresponding parts throughout the several views, there is shown in FIG. 1 a scroll compressor 10 that incorporates a discharge valve assembly 12 in accordance with the present invention. Compressor 10 comprises a generally cylindrical hermetic shell 14 having welded at the upper end thereof a cap 16 and at the lower end thereof a base 18 having a plurality of mounting feet (not shown) integrally formed therewith. Cap 16 is provided with a refrigerant discharge fitting 20. Other major elements affixed to shell 14 include a transversely extending partition 22 which is welded about its periphery at the same point that cap 16 is welded to shell 14, a main bearing housing 24 which is suitably secured to shell 14 and a two piece upper bearing housing 26 suitably secured to main bearing housing 24.

A drive shaft or crankshaft 30 having an eccentric crank pin 32 at the upper end thereof is rotatably journaled in a bearing 34 in main bearing housing 24 and a second bearing 36 in upper bearing housing 26. Crankshaft 30 has at the lower end a relatively large diameter concentric bore 38 which communicates with a radially outwardly inclined smaller diameter bore 40 extending upwardly therefrom to the top of crankshaft 30. The lower portion of the shell interior defines an oil sump 42 which is filled with lubricating oil to a level slightly above the lower end of a rotor 46, and bore 38 acts as a pump to pump lubricating oil up crankshaft 30 and into bore 40 and ultimately to all of the various portions of compressor 10 that require lubrication.

Crankshaft 30 is rotatably driven by an electric motor 48 including a stator 50, windings 52 passing therethrough and rotor 46 being press fit on crankshaft 30 and having upper and lower counterweights 54, 56, respectively.

An upper surface 58 of upper bearing housing 26 is provided with a flat thrust bearing surface on which is disposed an orbiting scroll member 60 having a spiral vane or wrap 62 extending upward from an end plate 64. Projecting downwardly from a lower surface of end plate 64 of orbiting scroll member 60 is a cylindrical hub 66 having a journal bearing 68 therein and in which is rotatably disposed a drive bushing 70 having an inner bore 72 in which crank pin 32 is drivingly disposed. Crank pin 32 has a flat on one surface that engages a flat surface (not shown) formed in a portion of bore 72 to provide a radially compliant driving arrangement, such as shown in assignee's U.S. Pat. No. 4,877,382, the disclosure of which is hereby incorporated herein by reference. An Oldham coupling 76 is also provided and positioned between orbiting scroll member 60 and upper bearing housing 26 and is keyed to orbiting scroll member 60 and a non-orbiting scroll member 80 to prevent rotational movement of orbiting scroll member 60. Oldham coupling 76 is preferably of the type disclosed in assignee's co-pending U.S. Pat. No. 5,320,506, the disclosure of which is hereby incorporated herein by reference.

Non-orbiting scroll member 80 is also provided having a wrap 82 extending downwardly from an end plate 84 that is positioned in meshing engagement with wrap 62 of orbiting scroll member 60. Non-orbiting scroll member 80 has a centrally disposed discharge passage 86 that communicates with an upwardly open recess 88 that in turn is in fluid communication with a discharge muffler chamber 90 defined by cap 16 and the partition 22. An annular recess 92 is also formed in non-orbiting scroll member 80, within which is disposed a floating seal assembly 94. Recesses 88, 92 and floating seal assembly 94 cooperate to define an axial pressure biasing chamber which receives pressurized fluid being compressed by wraps 62, 82 so as to exert an axial biasing force on the non-orbiting scroll member 80 to thereby urge tips of the respective wraps 62, 82 into sealing engagement with opposed end plate surfaces 98, 100 of end plates 64, 84, respectively. Floating seal assembly 94 is preferably of the type described in greater detail in U.S. Pat. No. 5,156,539, the disclosure of which is incorporated herein by reference. Non-orbiting scroll member 80 is designed to be mounted to main bearing housing 24 in a suitable manner such as disclosed in the aforementioned U.S. Pat. No. 4,877,382 or U.S. Pat. No. 5,102,316, the disclosures of which are incorporated herein by reference.

Figure 2:
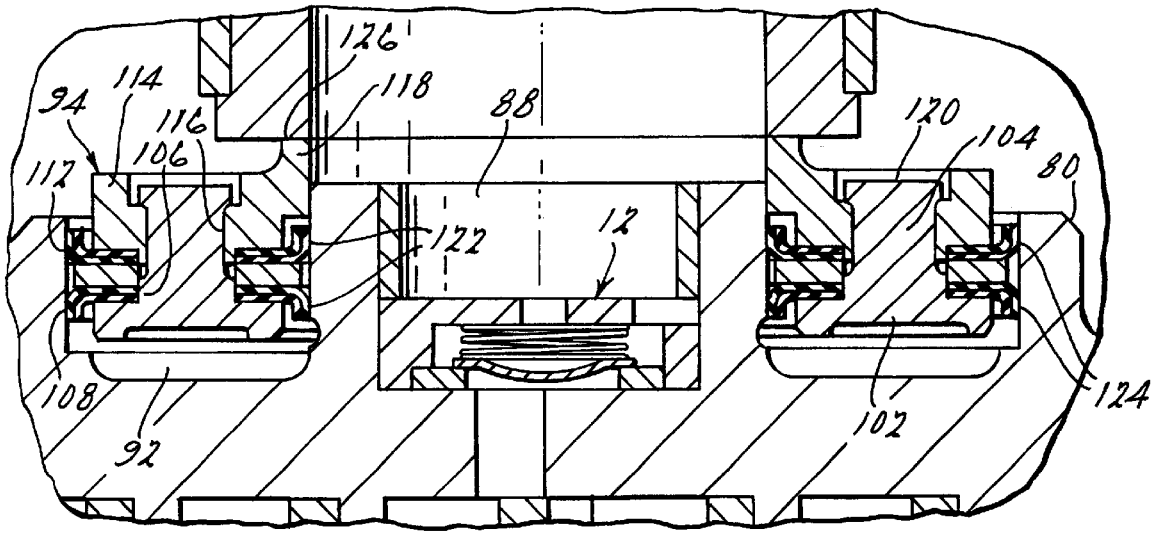
FIG. 2 is an enlarged view of a floating seal assembly and the discharge valve assembly of the compressor of FIG. 1.

Referring now to FIG. 2 floating seal assembly 94 is of a coaxial, sandwiched construction and comprises an annular base plate 102 having a plurality of equally spaced upstanding integral projections 104 each having an enlarged base portion 106. Disposed on plate 102 is an annular gasket assembly 108 having a plurality of equally spaced holes that mate with and receive base portion 106. Above gasket assembly 108 is disposed an annular spacer plate 110 having a plurality of equally spaces holes that also mate with and receive base portion 106. Above spacer plate 110 is an annular gasket assembly 112 having a plurality of equally spaced holes that mate with and receive projections 104. Seal assembly 94 is held together by an annular upper seal plate 114 that has a plurality of equally spaced holes mating with and receiving projections 104. Seal plate 114 includes a plurality of annular projections 116 that mate with and extend into the plurality of holes in annular gasket assembly 112 and spacer plate 110 to provide stability to seal assembly 94. Seal plate 114 also includes an annular upwardly projecting planar sealing lip 118. Seal assembly 94 is secured together by swaging the ends of projections 104 as indicated at 120.

Seal assembly 94 therefore provides three distinct seals. First, an inside diameter seal at two interfaces 122, second, an outside diameter seal at two interfaces 124 and a top seal 126. Seals 122 isolate fluid under intermediate pressure in the bottom of annular recess 92 from fluid in recess 88. Seals 124 isolate fluid under intermediate pressure in the bottom of annular recess 92 from fluid within shell 14. Seal 126 is between sealing lip 118 and an annular seat portion on partition 22. The seal 126 isolates fluid at suction pressure from fluid at discharge pressure across the top of seal assembly 94.

The diameter and width of seal 126 are chosen so that the unit pressure between sealing lip 118 and the seat portion on partition 22 is greater than normally encountered discharge pressure, thus ensuring consistent sealing under normal operating conditions of compressor 10 (i.e. at normal operating pressure ratios). Therefore, when undesirable pressure conditions are encountered, seal assembly 94 will be forced downward breaking seal 126, thereby permitting fluid flow from the discharge pressure zone of compressor 10 to the suction pressure zone of compressor 10. If this flow is great enough, the resultant loss of flow of motor-cooling suction gas (aggravated by the excessive temperature of the leaking discharge gas) will cause a motor protector to trip thereby de-energizing motor. The width of seal 126 is chosen so that the unit pressure between the sealing lip 118 and the seat portion of partition 22 is greater than normally encountered discharge pressure, thus ensuring consistent sealing.

Scroll compressor 10 as thus far broadly described is either now known in the art or is the subject of other pending applications for patent or patents of applicant's assignee.

Figure 3:
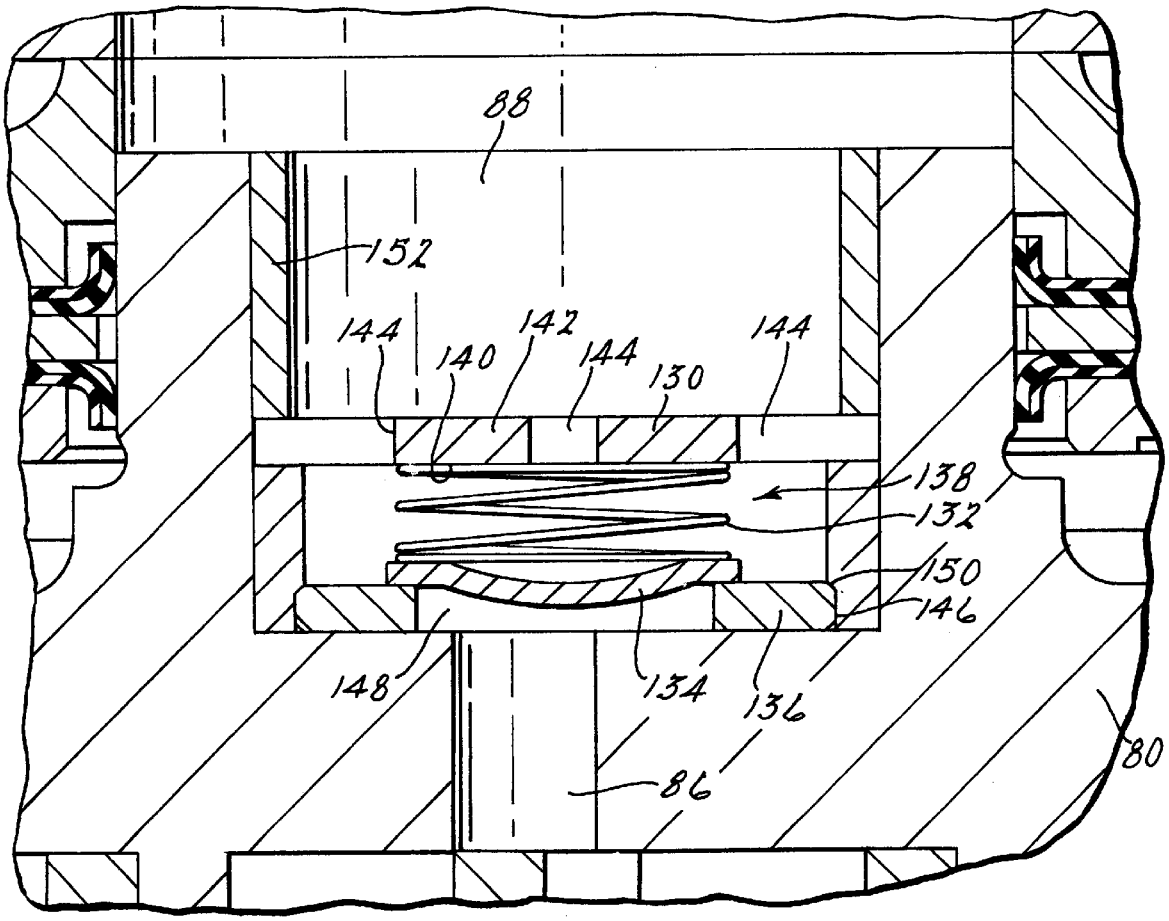
FIG. 3 is an enlarged view of the discharge valve assembly in a closed position.

The present invention is directed towards normally closed mechanical discharge valve assembly 12 that is disposed within recess 88 that is formed in non-orbiting scroll member 80. Discharge valve assembly 12 moves between a fully closed and a fully open condition during steady state operation of compressor 10. Valve assembly 12 will close during the shut down of compressor 10. When valve assembly 12 is fully closed, the recompression volume is minimized and the reverse flow of discharge gas through scroll members 60, 80 is prohibited. Valve assembly 12 is normally closed as shown in FIGS. 2 and 3. The normally closed configuration for valve assembly 12 requires a discharge force (i.e. pressure differential) to open valve assembly 12. Valve assembly 12 relies on mechanical biasing for closing.

Figure 4:
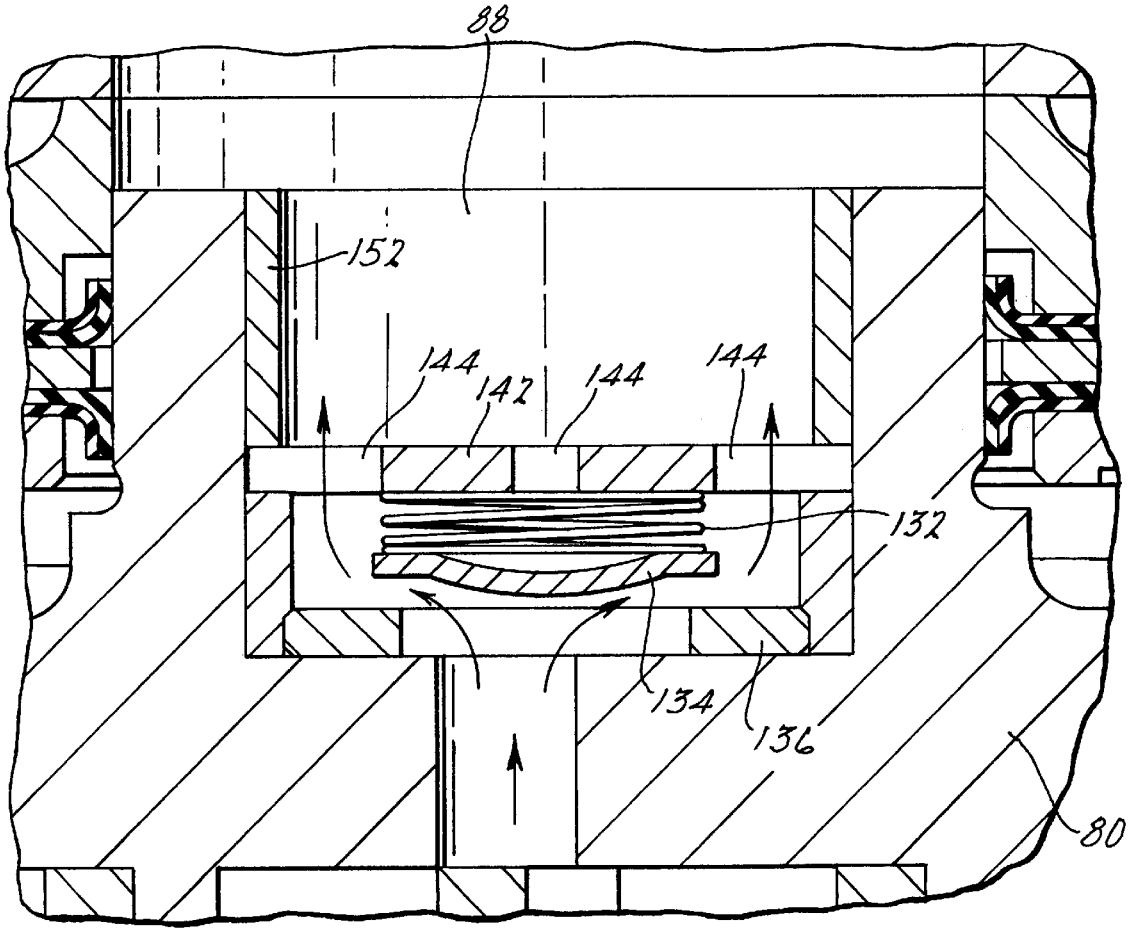
FIG. 4 is an enlarged view of the discharge valve assembly in an open position.

Referring now to FIGS. 2 through 4, discharge valve assembly 12 includes a housing 130, a spring 132, a contoured disc 134 and a valve plate 136. Spring 132 seats within a cavity 138 of housing 130 against an inner face 140 of a top wall 142 of housing 130. A series of flow orifices 144 are disposed through the top wall 142 of housing 130. Contoured disc 134 is operably interconnected with spring 132, whereby spring 132 biases contoured disc 134 downward within cavity 138. Valve plate 136 seats within a recess 146 of housing 130 and includes a flow aperture 148 therethrough. Flow aperture 148 is in direct fluid communication with discharge passage 86 of non-orbiting scroll member 80. Spring 132 biases contoured disc 134 into sealed contact with valve plate 136, thereby defining the closed configuration. The present embodiment of contoured disc 134 is provided as a dome-shaped disc. The domed disc provides an advantage of more stable flow through discharge valve assembly 12, thereby reducing the pressure difference thereacross. Further advantages are seen in the reduction of tensile stress that the contoured disc experiences, as discussed in further detail below.

Discharge valve assembly 12 is assembled into non-orbiting scroll member 80 by housing 130 seating within recess 88 with flow orifices 144 facing upward. Valve plate 136 seats within recess 146 against a bottom face 150 of recess 146. A retainer 152 is installed within recess 88 to maintain the assembly of discharge valve assembly 12 in non-orbiting scroll member 80. Retainer 152 can be connected to non-orbiting scroll member 80 by being press fit within recess 88. Alternatively, retainer 152 and recess 88 can be threaded to provide the connection or other means known in the art can be used to secure retainer 152 within recess 88. The assembly of retainer 152 sandwiches the entire discharge valve assembly 12 between the bottom surface of recess 88 and retainer 152.

Discharge valve assembly 12 is normally biased in its closed position with contoured disc 134 abutting an upper flat surface of valve plate 136, thereby providing the closed configuration. This prohibits fluid flow from discharge muffler chamber 90 into the compression pockets formed by scroll members 60, 80. In order to open discharge valve assembly 12, fluid pressure within discharge passage 86 biases contoured disc 134 against the biasing force of spring 132. This occurs when the fluid pressure in discharge passage 86 is greater than the fluid pressure within muffler chamber 90. During operation of compressor 10, the fluid pressure differential between fluid in muffler chamber 90 and fluid within discharge passage 86 will move contoured disc 134 between abutment with surface of valve plate 136 and an intermediate position within cavity 138 (i.e. between a closed position and an open position). As best seen in FIG. 4, when contoured disc 134 is in an intermediate position within cavity 138, fluid flow (represented with arrows) is enabled from discharge passage 86, through flow aperture 148 of valve plate 136, around the periphery of contoured disc 134 and out to muffler chamber 90 through flow orifices 144. Discharge valve assembly 12 of the present invention operates solely on pressure differentials. The unique design of contoured disc 134 provides a stronger component to improve the durability of the system.

More specifically, tensile stress is present in contoured disc 134 as a result of the pressure difference thereacross. Given a traditional flat disc, flooded start failures of compressors may occur due to failure of the disc under cyclical tensile loads. The present invention, by providing a contoured disc, significantly reduces the stress loading experienced by the disc. In fact, use of a contoured disc can reduce stress loading by a factor of four (4), without increasing the disc thickness. As discussed above, the present embodiment provides a domed disc. It will be appreciated, however that contoured disc 134 may include any one of a variety of contoured forms. The domed-disc of the present embodiment includes an apex that is directed toward discharge passage 86. In this manner, smooth fluid flow around contoured disc 134 is enabled. The smooth fluid flow reduces the pressure differential experienced across contoured disc 134, thereby further reducing stress loading therein.

Figure 5:
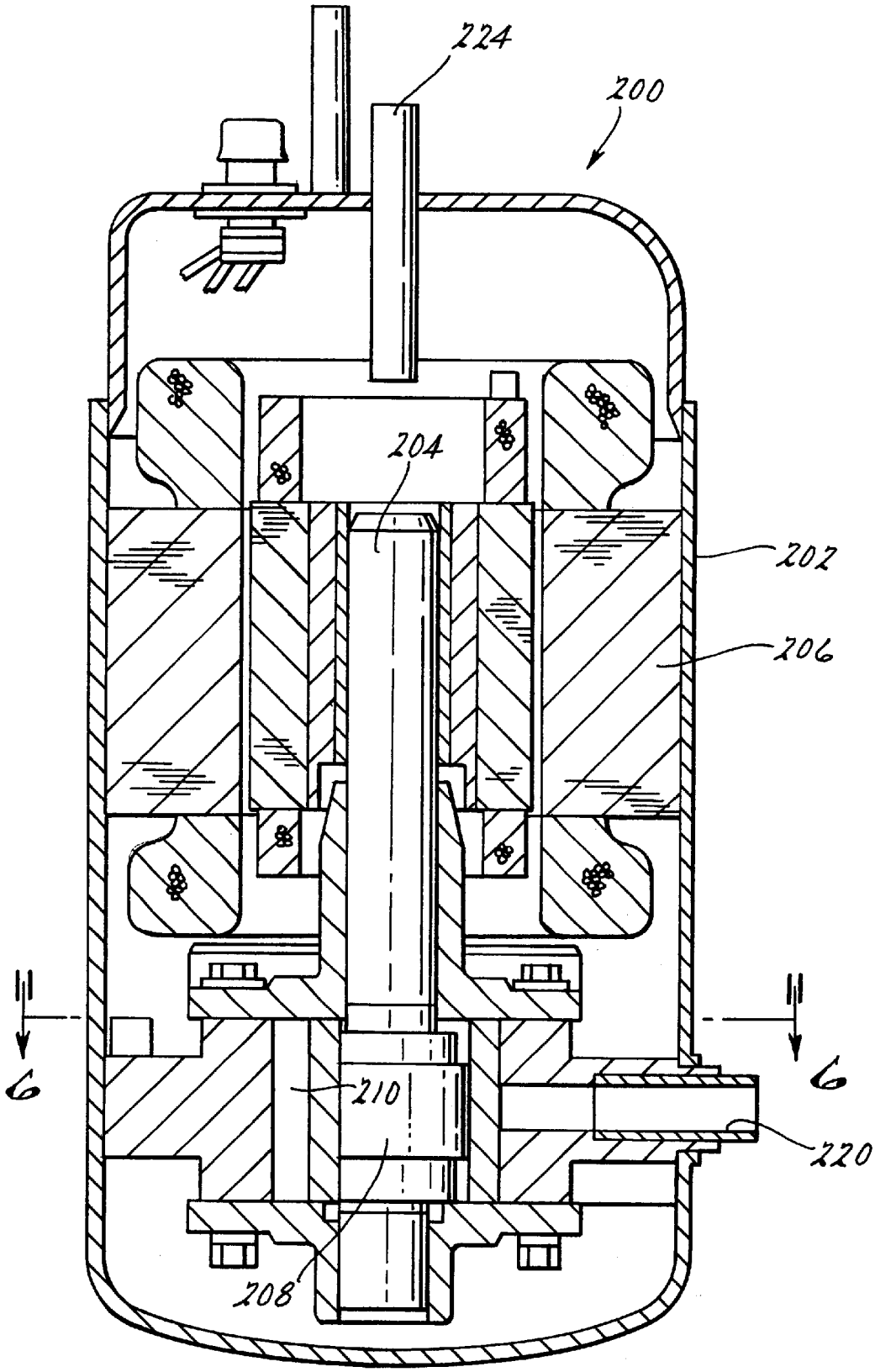
FIG. 5 is a vertical sectional view through the center of a conventional single-vane rotary compressor which incorporates the discharge valve assembly of the present invention.
Figure 6:
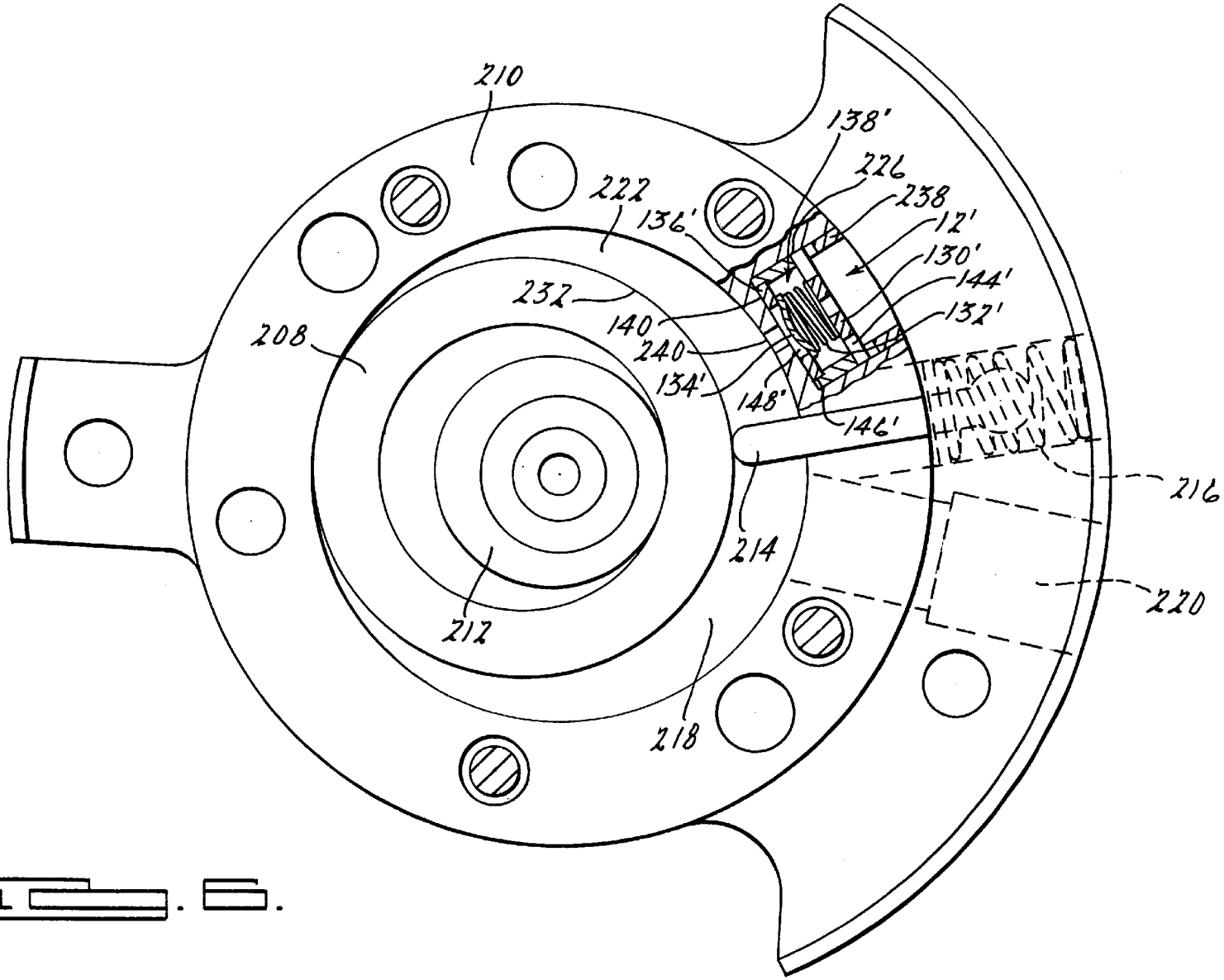
FIG. 6 is a cross-sectional view in the direction of arrows 6—6 shown in FIG. 5.

Referring now to FIGS. 5 and 6, a rotary compressor 200 is illustrated which incorporates a discharge valve assembly 12' in accordance with the present invention. Compressor 200 comprises a housing 202, a shaft 204 that is connected to a motor 206 provided in housing 202, a roller 208 eccentrically mounted at the lower end of shaft 204, and a cylinder 210 enclosing roller 208 as shown in FIG. 5. An eccentric 212 (FIG. 6) is attached to shaft 204 and is freely movably disposed in roller 208. A valve 214 is provided and disposed on a wall of cylinder 210. A spring 216 continuously urges valve 214 against roller 208. As shaft 204 is rotated by motor 206, roller 208 rotates in an eccentric manner to compress refrigerant taken into a suction area 218 through a suction pipe 220. Pressurized gas is discharged from a discharge area 222 of cylinder 210 and discharges through a pipe 224 provided at the top of housing 202. Cylinder 210 defines a recess 226 within which is located discharge valve assembly 12'. Cylinder 210 further defines a discharge passage 240 in fluid communication with recess 226 and discharge valve assembly 12'.

Discharge valve assembly 12' is disposed within recess 226 and includes a housing 130', a spring 132', a contoured disc 134' and a valve plate 136'. Spring 132' seats within a cavity 138' of housing 130' against an inner face 140' of a top wall 142' of housing 130'. A series of flow orifices 144' are disposed through top wall 142' of housing 130'. Contoured disc 134' is operably interconnected with spring 132', whereby spring 132' biases contoured disc 134' downward within cavity 138'. Valve plate 136' seats within a recess 146' of housing 130' and includes a flow aperture 148' therethrough. Flow aperture 148' is in direct fluid communication with discharge passage 240 of cylinder 210. Spring 132' biases contoured disc 134' into sealed contact with valve plate 136', thereby defining the closed configuration. Discharge valve assembly 12' is held into recess 226 by a press-fit retainer 238.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A scroll compressor comprising:

a shell defining a discharge chamber;

a first scroll member disposed within said shell, said first scroll member having a first spiral wrap projecting outwardly from an end plate;

a second scroll member disposed within said shell, said second scroll member having a second spiral wrap projecting outwardly from an end plate, said second spiral wrap intermeshed with said first spiral wrap;

a drive member for causing said scroll members to orbit relative to one another whereby said spiral wraps create pockets of progressively changing volume between a suction pressure zone and a discharge pressure zone;

a discharge passage providing fluid communication between said discharge pressure zone and said discharge chamber; and a discharge valve assembly disposed within said discharge passage, said discharge valve assembly comprising;

a housing disposed within said discharge passage, said housing defining a plurality of flow orifices disposed circumferentially around a top wall of said housing and a flat valve seat around a bottom wall of said housing;

an aperture free discharge valve disc defining an outer flat periphery, said discharge valve disc being movable between a first position where said outer flat periphery engages said flat valve seat to prohibit fluid flow through said discharge passage and a second position which allows fluid flow through said discharge passage, said fluid flow through said discharge passage flowing around said outer periphery of said discharge valve disc and through said plurality of flow orifices, said discharge valve disc having a contoured body having a uniform thickness for reducing a stress load experienced by said discharge valve disc and a biasing member engaging said outer flat periphery of said discharge valve disc to urge said discharge valve disc toward said first position.

2. The scroll compressor of claim 1, wherein said contoured body of said discharge valve disc includes a convex side.

3. The scroll compressor of claim 2, wherein said convex side is directed upstream of a fluid flow for enabling smooth fluid flow around said outer flat periphery of said discharge valve disc.

4. The scroll compressor of claim 1, wherein said contoured body is generally dome-shaped.

5. The scroll compressor of claim 4, wherein said contoured body includes a convex side directed upstream of a fluid flow for enabling smooth fluid flow around said outer flat periphery of said discharge valve disc.

6. The scroll compressor of claim 1 where said flat valve seat comprises a valve plate disposed within said discharge passage.

7. The scroll compressor of claim 1 wherein said biasing member is disposed between said housing and said discharge valve disc for biasing said discharge valve disc toward said first position.

8. The scroll compressor of claim 7, wherein said biasing member is a coiled compression spring.

9. A rotary compressor comprising:

a shell defining a discharge chamber;

a housing disposed within said shell, said housing defining a chamber;

a roller disposed within said chamber;

a vane disposed between said housing and said roller, said vane dividing said chamber into a suction area and a discharge area;

a discharge passage providing fluid communication between said discharge area and said chamber;

a drive member for causing said roller to rotate within said chamber whereby fluid in said suction area progressively changes volume as it is moved into said discharge area; and a discharge valve assembly disposed within said discharge passage, said discharge valve assembly comprising;

a housing disposed within said discharge passage, said housing defining a plurality of flow orifices disposed circumferentially around a top wall of said housing and a flat valve seat around a bottom wall of said housing;

an aperture free discharge valve disc defining an outer flat periphery, said discharge valve disc being movable between a first position where said outer flat periphery engages said flat valve seat to prohibit fluid flow through said discharge passage and a second position which allows fluid flow through said discharge passage, said fluid flow through said discharge passage flowing around said outer periphery of said discharge valve disc and through said plurality of flow orifices, said discharge valve disc having a contoured body having a uniform thickness for reducing a stress load experienced by said discharge valve disc and a biasing member engaging said outer flat periphery of said discharge valve disc to urge said discharge valve disc toward said first position.

10. The rotary compressor of claim 9, wherein said contoured body of said discharge valve disc includes a convex side.

11. The rotary compressor of claim 10, wherein said convex side is directed upstream of a fluid flow for enabling smooth fluid flow around said outer flat periphery of said discharge valve disc.

12. The rotary compressor of claim 9, wherein said contoured body is generally dome-shaped.

13. The rotary compressor of claim 12, wherein said contoured body includes a convex side directed upstream of a fluid flow for enabling smooth fluid flow around said outer flat periphery of said discharge valve disc.

14. The rotary compressor of claim 9 where said flat valve seat comprises a valve plate disposed within said discharge passage.

15. The rotary compressor of claim 9 where said biasing member is disposed between said housing and said discharge valve disc for biasing said discharge valve disc toward said first position.

16. The rotary compressor of claim 15, wherein said biasing member is a coiled compression spring.

17. A compressor comprising:

a discharge chamber;

a discharge pressure zone;

a discharge passage interconnecting said discharge chamber and said discharge pressure zone for fluid communication therebetween; and a discharge valve assembly disposed within said discharge passage, said discharge valve assembly comprising;

a housing disposed within said discharge passage, said housing defining a plurality of flow orifices disposed circumferentially around a top wall of said housing and a flat valve seat around a bottom wall of said housing;

an aperture free discharge valve disc defining an outer flat periphery, said discharge valve disc being movable between a first position where said outer flat periphery engages said flat valve seat to prohibit fluid flow through said discharge passage and a second position which allows fluid flow through said discharge passage, said fluid flow through said discharge passage flowing around said outer periphery of said discharge valve disc and through said plurality of flow orifices, said discharge valve disc having a contoured body having a uniform thickness for reducing a stress load experienced by said discharge valve disc and a biasing member engaging said outer flat periphery of said discharge valve disc to urge said discharge valve disc toward said first position.

18. The compressor of claim 17, wherein said compressor is a scroll compressor.

19. The compressor of claim 18, wherein said contoured body of said discharge valve disc includes a convex side.

20. The compressor of claim 19, wherein said convex side is directed upstream of a fluid flow for enabling smooth fluid flow around said outer flat periphery of said discharge valve disc.

21. The compressor of claim 18, wherein said contoured body is generally dome-shaped.

22. The compressor of claim 21, wherein said contoured body includes a convex side directed upstream of a fluid flow for enabling smooth fluid flow around said outer flat periphery of said discharge valve disc.

23. The compressor of claim 18 where said flat valve seat comprises a valve plate disposed within said discharge passage.

24. The compressor of claim 18 where said biasing member is disposed between said housing and said discharge valve disc for biasing said discharge valve disc toward said first position.

25. The compressor of claim 24, wherein said biasing member is a coiled compression spring.

26. The compressor of claim 17, wherein said compressor is a single-vane rotary compressor.

27. The compressor of claim 26, wherein said contoured body of said discharge valve disc includes a convex side.

28. The compressor of claim 27, wherein said convex side is directed upstream of a fluid flow for enabling smooth fluid flow around said outer flat periphery of said discharge valve disc.

29. The compressor of claim 26, wherein said contoured body is generally dome-shaped.

30. The compressor of claim 29, wherein said contoured body includes a convex side directed upstream of a fluid flow for enabling smooth fluid flow around said outer flat periphery of said discharge valve disc.

31. The compressor of claim 26 where said valve seat comprises a valve plate disposed within said discharge passage.

32. The compressor of claim 26 where said biasing member is disposed between said housing and said discharge valve disc for biasing said discharge valve disc toward said first position.

33. The compressor of claim 32, wherein said biasing member is a coiled compression spring.

* * * * *

UNITED STATES PATENT AND TRADEMARK OFFICE

CERTIFICATE OF CORRECTION

PATENT NO. : 6,537,043 B1
DATED : March 25, 2003
INVENTOR(S) : Jianxiong Chen

It is certified that error appears in the above-identified patent and that said Letters Patent is hereby corrected as shown below:

Column 2,
Line 61, "be" should be -- by --.

Column 4,
Line 13, "spaces" should be -- spaced --.

Column 7,
Line 44, "where" should be -- wherein --.

Column 8,
Lines 37 and 40, "where" should be -- wherein --.

Column 9,
Lines 22 and 25, "where" should be -- wherein --.

Column 10,
Lines 18 and 21, "where" should be -- wherein --.

Signed and Sealed this

Ninth Day of September, 2003

JAMES E. ROGAN
*Director of the United States Patent and Trademark Office*